US008234872B2

(12) United States Patent
Berry et al.

(10) Patent No.: US 8,234,872 B2
(45) Date of Patent: Aug. 7, 2012

(54) TURBINE AIR FLOW CONDITIONER

(75) Inventors: Jonathan Dwight Berry, Greenville, SC (US); Jason Thurman Stewart, Greer, SC (US)

(73) Assignee: General Electric Company, Schenectady, NY (US)

( * ) Notice: Subject to any disclaimer, the term of this patent is extended or adjusted under 35 U.S.C. 154(b) by 734 days.

(21) Appl. No.: 12/434,505

(22) Filed: May 1, 2009

(65) Prior Publication Data

US 2010/0275601 A1 Nov. 4, 2010

(51) Int. Cl.
*F02C 1/00* (2006.01)
*F02G 3/00* (2006.01)

(52) U.S. Cl. ..... 60/737; 60/752; 60/753; 60/754; 60/755; 60/756; 60/757; 60/758; 60/759; 60/760; 60/804; 60/725; 60/746; 60/747; 60/748; 239/590.3; 239/590.5

(58) Field of Classification Search ..... 60/737, 60/752–760, 804, 746–748, 725; 239/590.3, 239/590.5
See application file for complete search history.

(56) References Cited

U.S. PATENT DOCUMENTS

| | | | | |
|---|---|---|---|---|
| 6,438,959 | B1 | 8/2002 | Dean et al. | |
| 6,438,961 | B2 | 8/2002 | Tuthill et al. | |
| 6,634,175 | B1 | 10/2003 | Kawata et al. | |
| 6,901,760 | B2 | 6/2005 | Dittmann et al. | |
| 2007/0199325 | A1 * | 8/2007 | Tanimura et al. | 60/740 |
| 2007/0227148 | A1 | 10/2007 | Bland et al. | |
| 2009/0320484 | A1 * | 12/2009 | Lacy et al. | 60/748 |

OTHER PUBLICATIONS

Tanimura, S., et al.; "Advanced Dry Low Nox Combustor for Mitsubishi G Class Gas Turbines," Proceedings of ASME Turbo Expo 2008: Power for Land, Sea and Air; Jun. 9-13, 2008, Berlin, Germany, GT2008-50819; 9 pages.

* cited by examiner

*Primary Examiner* — William H Rodriguez
*Assistant Examiner* — Craig Kim
(74) *Attorney, Agent, or Firm* — Fletcher Yoder P.C.

(57) ABSTRACT

A system includes an air flow conditioner configured to mount in an air chamber separated from a combustion chamber of a turbine combustor. The air flow conditioner comprises a perforated annular wall configured to direct an air flow in both an axial direction and a radial direction relative to an axis of the turbine combustor. In addition, the air flow conditioner is configured to uniformly supply the air flow into air inlets of one or more fuel nozzles.

26 Claims, 13 Drawing Sheets

TURBINE AIR FLOW CONDITIONER

BACKGROUND OF THE INVENTION

The subject matter disclosed herein relates generally to turbine engines and, more specifically, to an air flow conditioning system to improve air distribution within an air chamber.

Fuel-air mixing affects engine performance and emissions in a variety of engines, such as turbine engines. For example, a gas turbine engine may employ one or more fuel nozzles to intake air and fuel to facilitate fuel-air mixing in a combustor. The nozzles may be located in a head end portion of a turbine, and may be configured to intake an air flow to be mixed with a fuel input. Unfortunately, the air flow may not be distributed evenly among a plurality of nozzles, leading to an inconsistent mixture of fuel and air. Further, in a single nozzle embodiment, the air flow may be uneven within the nozzle due to the geometry within the head end of the turbine combustor. As such, uneven or non-uniform flow within the fuel nozzle may lead to inadequate mixing with fuel, thereby reducing performance and efficiency of the turbine engine. As a result, the air flow into the head end may cause increased emissions and reduce performance due to uneven flow of air into each nozzle and among a plurality of nozzles.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a turbine engine. The turbine engine includes a combustor. The combustor includes a combustion chamber. The combustor also includes an air chamber. The combustor further includes a divider between the combustion chamber and the air chamber. In addition, the combustor includes a fuel nozzle extending through the divider. The fuel nozzle has an air inlet in the air chamber and an outlet in the combustion chamber. The combustor also includes an air flow conditioner disposed in the air chamber along an air supply path into the air chamber. The air flow conditioner includes a perforated turning vane configured to turn an air flow from the air supply path inwardly toward a central region of the air chamber.

In a second embodiment, a system includes an air flow conditioner configured to mount in an air chamber separated from a combustion chamber of a turbine combustor. The air flow conditioner comprises a perforated annular wall configured to direct an air flow in both an axial direction and a radial direction relative to an axis of the turbine combustor. In addition, the air flow conditioner is configured to uniformly supply the air flow into air inlets of one or more fuel nozzles.

In a third embodiment, a system includes a turbine combustor. The turbine combustor includes a combustion chamber. The turbine combustor also includes a head end upstream from the combustion chamber relative to a flow of combustion products. The head end includes a fuel nozzle disposed in the head end. The fuel nozzle comprises an air inlet at a first axial position relative to a longitudinal axis of the turbine combustor. The head end also includes an air flow conditioner disposed in the head end. The air flow conditioner is disposed at a second axial position relative to the longitudinal axis. The first axial position is different from the second axial position.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
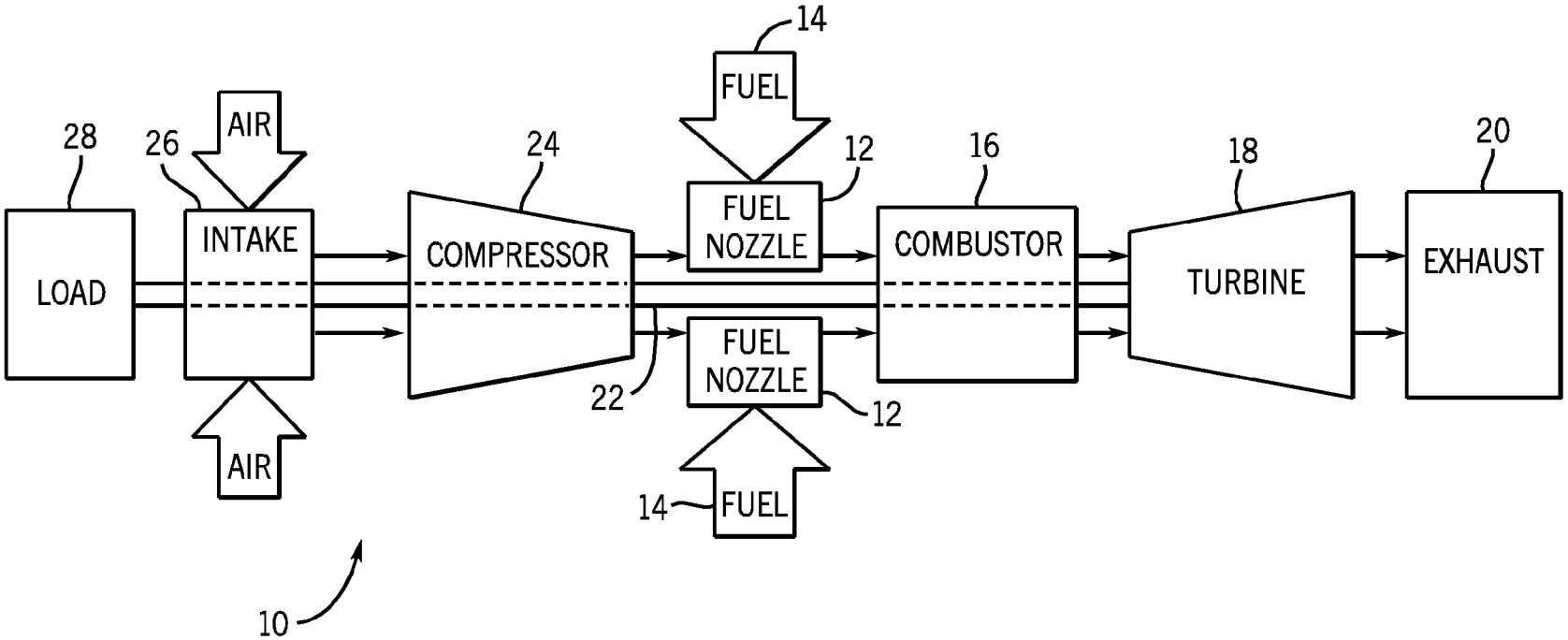
FIG. 1 is a block diagram of an embodiment of a turbine system having an air flow conditioner.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment" or "an embodiment" of the present invention are not intended to be interpreted as excluding the existence of additional embodiments that also incorporate the recited features.

As discussed in detail below, various embodiments of air flow conditioners and related structures may be employed to improve the performance and reduce emissions of a turbine engine. For example, the disclosed air flow conditioners may be disposed in a head end region of a gas turbine combustor, such that the air flow conditioner improves the distribution and uniformity of air flow to one or more fuel nozzles. The air flow conditioner is configured to improve the uniformity of air flow among a plurality of fuel nozzles (i.e., if more than one is present), while also improving the uniformity of air flow into each fuel nozzle (e.g., into an air flow conditioner about a circumference of each fuel nozzle).

For example, embodiments of the air flow conditioner may include a perforated turning vane, wherein the perforated turning vane is an annular structure with a diameter that varies along the longitudinal axis of the combustor. Specifically, the perforated turning vane may be convex or concave, wherein the perforated turning vane is configured to direct air flow axially and radially, inward and outward, along the combustor longitudinal axis. By directing the air in multiple directions, including radially and axially, the perforated turning vane is configured to break large scale flow structures into smaller flow structures, thereby producing a balanced mass flow of air within the air chamber of the head end of the combustor.

In another embodiment, the perforated turning vane may be conical or annular in geometry, and may also be configured to direct air flow axially and radially within the air chamber. Further, the perforated turning vane may also be coupled to a perforated cylinder or wall, which may be an annular structure configured to direct air in a radial direction. The perforated annular wall or cylinder, along with the perforated turning vane, may be utilized to break up flow structures within the air chamber to distribute air evenly in a balanced fashion to one or more fuel nozzles within the air chamber.

Accordingly, the improved and balanced flow of air to the one or more fuel nozzles will lead to more predictable mixtures of air and fuel within the combustor, thereby improving performance. In addition, the perforated air flow conditioner, including the perforated turning vane annular member, may improve flow to individual fuel nozzles by making the air flow more even into the fuel nozzle. The perforated air flow conditioner, including the perforated turning vane, may also distribute air more evenly and balanced within the air chamber of the head end, thereby ensuring an even distribution of air intake among a plurality of fuel nozzles. As such, an even distribution of air among fuel nozzles improves combustion performance, thereby reducing emissions and improving system efficiency.

Turning now to the drawings and referring first to FIG. 1, a block diagram of an embodiment of a turbine system 10 is illustrated. As discussed in detail below, the disclosed turbine system 10 may employ an air flow conditioner for improving the performance and reducing emissions from the turbine system 10. The turbine system 10 may use liquid or gas fuel, such as natural gas and/or a hydrogen rich synthetic gas, to run the turbine system 10. As depicted, a plurality of fuel nozzles 12 intakes a fuel supply 14, mixes the fuel with air, and distributes the air-fuel mixture into a combustor 16. The air-fuel mixture combusts in a chamber within combustor 16, thereby creating hot pressurized exhaust gases. The combustor 16 directs the exhaust gases through a turbine 18 toward an exhaust outlet 20. As the exhaust gases pass through the turbine 18, the gases force one or more turbine blades to rotate a shaft 22 along an axis of the system 10. As illustrated, the shaft 22 may be connected to various components of the turbine system 10, including a compressor 24. The compressor 24 also includes blades that may be coupled to the shaft 22. As the shaft 22 rotates, the blades within the compressor 24 also rotate, thereby compressing air from an air intake 26 through the compressor 24 and into the fuel nozzles 12 and/or combustor 16. The shaft 22 may also be connected to a load 28, which may be a vehicle or a stationary load, such as an electrical generator in a power plant or a propeller on an aircraft, for example. As will be understood, the load 28 may include any suitable device capable of being powered by the rotational output of turbine system 10.

Figure 2:
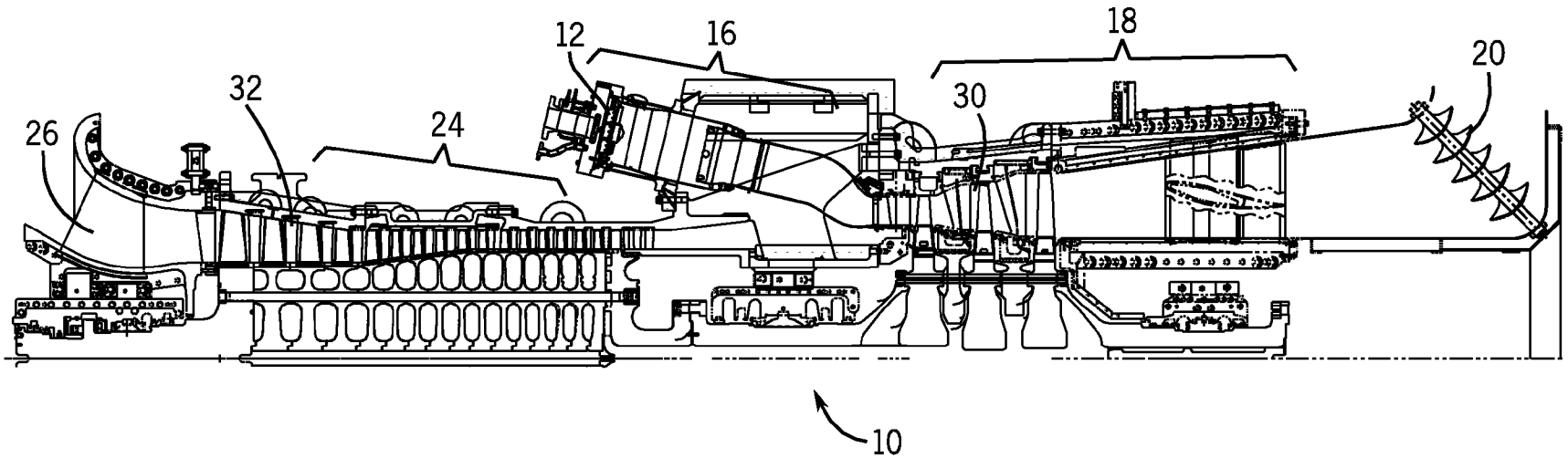
FIG. 2 is a cross sectional side view of an embodiment of the turbine system, as illustrated in FIG. 1, with a combustor having one or more fuel nozzles.

FIG. 2 illustrates a cross sectional side view of an embodiment of the turbine system 10 schematically depicted in FIG. 1. The turbine system 10 includes one or more fuel nozzles 12 located inside one or more combustors 16. In operation, air enters the turbine system 10 through the air intake 26 and may be pressurized in the compressor 24. The compressed air may then be mixed with gas for combustion within combustor 16. For example, the fuel nozzles 12 may inject a fuel-air mixture into the combustor 16 in a suitable ratio for optimal combustion, emissions, fuel consumption, and power output. The combustion generates hot pressurized exhaust gases, which then drive one or more blades 30 within the turbine 18 to rotate the shaft 22 and, thus, the compressor 24 and the load 28. The rotation of the turbine blades 30 causes a rotation of the shaft 22, thereby causing blades 32 within the compressor 22 to draw in and pressurize the air received by the intake 26.

As discussed in detail below, an embodiment of the turbine system 10 includes certain structures and components within a head end of the combustor 16 to improve flow of air into the fuel nozzles 12, thereby improving performance and reducing emissions. For example, an air flow conditioner, including a perforated turning vane, may be placed in the air flow path into an air chamber, wherein the perforated turning vane directs air in an even and balanced fashion to improve distribution of air into the fuel nozzles 12, thereby improving the fuel-air mixture ratio and enhancing accuracy of the ratio.

Figure 3:
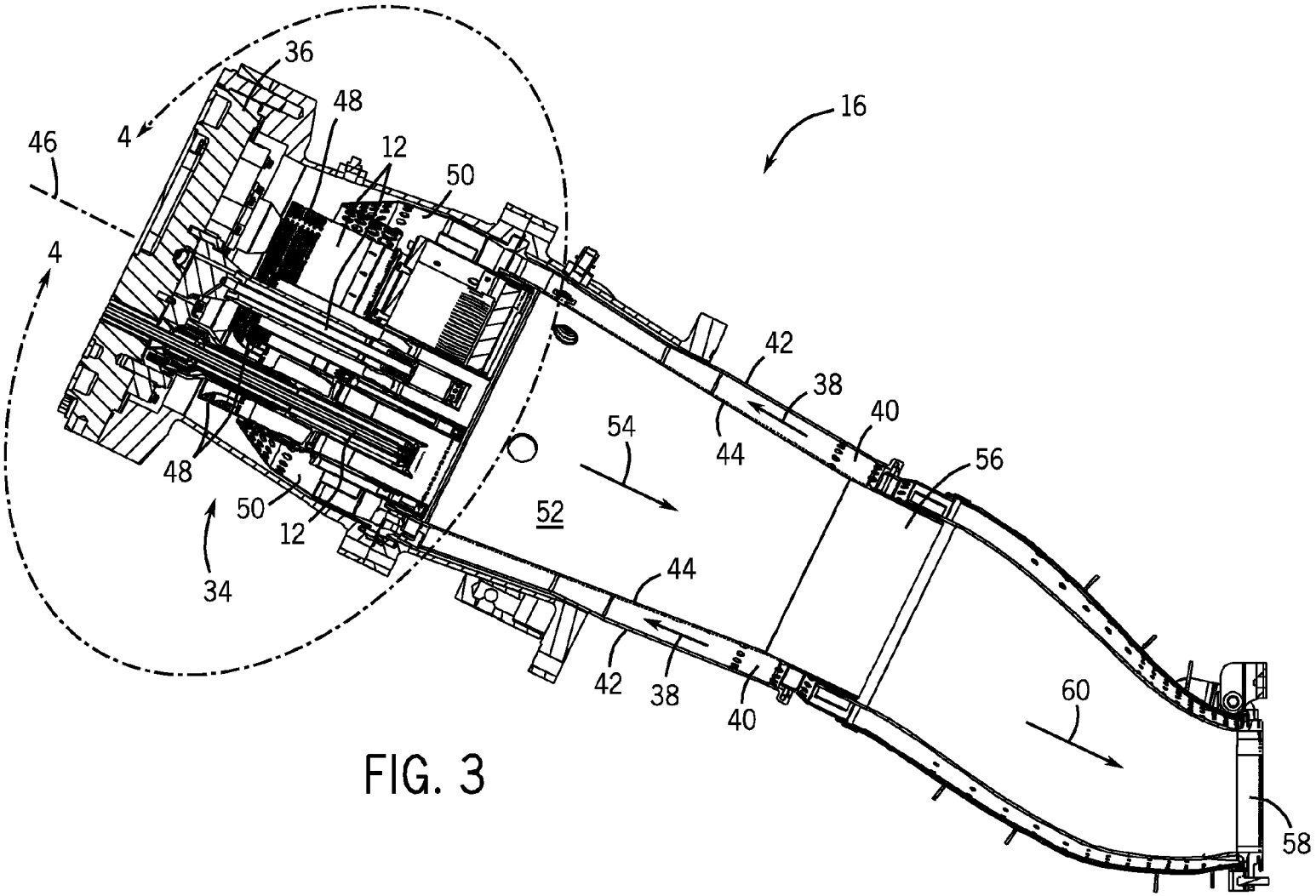
FIG. 3 is a cross sectional side view of an embodiment of the combustor having one or more fuel nozzles, as illustrated in FIG. 2, which may be positioned to draw compressed air from a head end region.

FIG. 3 is a cross sectional side view of an embodiment of the combustor 16 having one or more fuel nozzles 12, which may be positioned to draw compressed air from a head end region 34. An end cover 36 may include conduits or channels that route fuel and/or pressurized gas to the fuel nozzles 12. Compressed air 38 from the compressor 24 flows into the combustor 16 through an annular passage 40 formed between a combustor flow sleeve 42 and a combustor liner 44. The compressed air 38 flows into the head end region 34, which contains a plurality of fuel nozzles 12. In particular, in certain embodiments, the head end region 34 may include a central fuel nozzle 12 extending through a central longitudinal axis 46 of the head end region 34 and a plurality of outer fuel nozzles 12 disposed around the central longitudinal axis 46. However, in other embodiments, the head end region 34 may include only one fuel nozzle 12 extending through the central longitudinal axis 46. The particular configuration of fuel nozzles 12 within the head end region 34 may vary between particular designs.

In general, however, the compressed air 38 which flows into the head end region 34 may flow into the fuel nozzles 12 through a nozzle inlet flow conditioner having inlet perforations 48, which may be disposed in outer cylindrical walls of the fuel nozzles 12. As discussed in greater detail below, an air flow conditioner 50 may break up large scale flow structures (e.g., a single annular jet) of the compressed air 38 into smaller scale flow structures as the compressed air 38 is routed into the head end region 34. In addition, the air flow conditioner 50 guides or channels the air flow in a manner providing more uniform air flow distribution among the different fuel nozzles 12, which also improves the uniformity of air flow into each individual fuel nozzle 12. Accordingly, the compressed air 38 may be more evenly distributed to balance air intake among the fuel nozzles 12 within the head end region 34. The compressed air 38 that enters the fuel nozzles 12 via the inlet perforations 48 mixes with fuel and flows through an interior volume 52 of the combustor liner 44, as illustrated by arrow 54. The air and fuel mixture flows into a combustion cavity 56, which may function as a combustion burning zone. The heated combustion gases from the combustion cavity 56 flow into a turbine nozzle 58, as illustrated by arrow 60, where they are delivered to the turbine 18.

Figure 4:
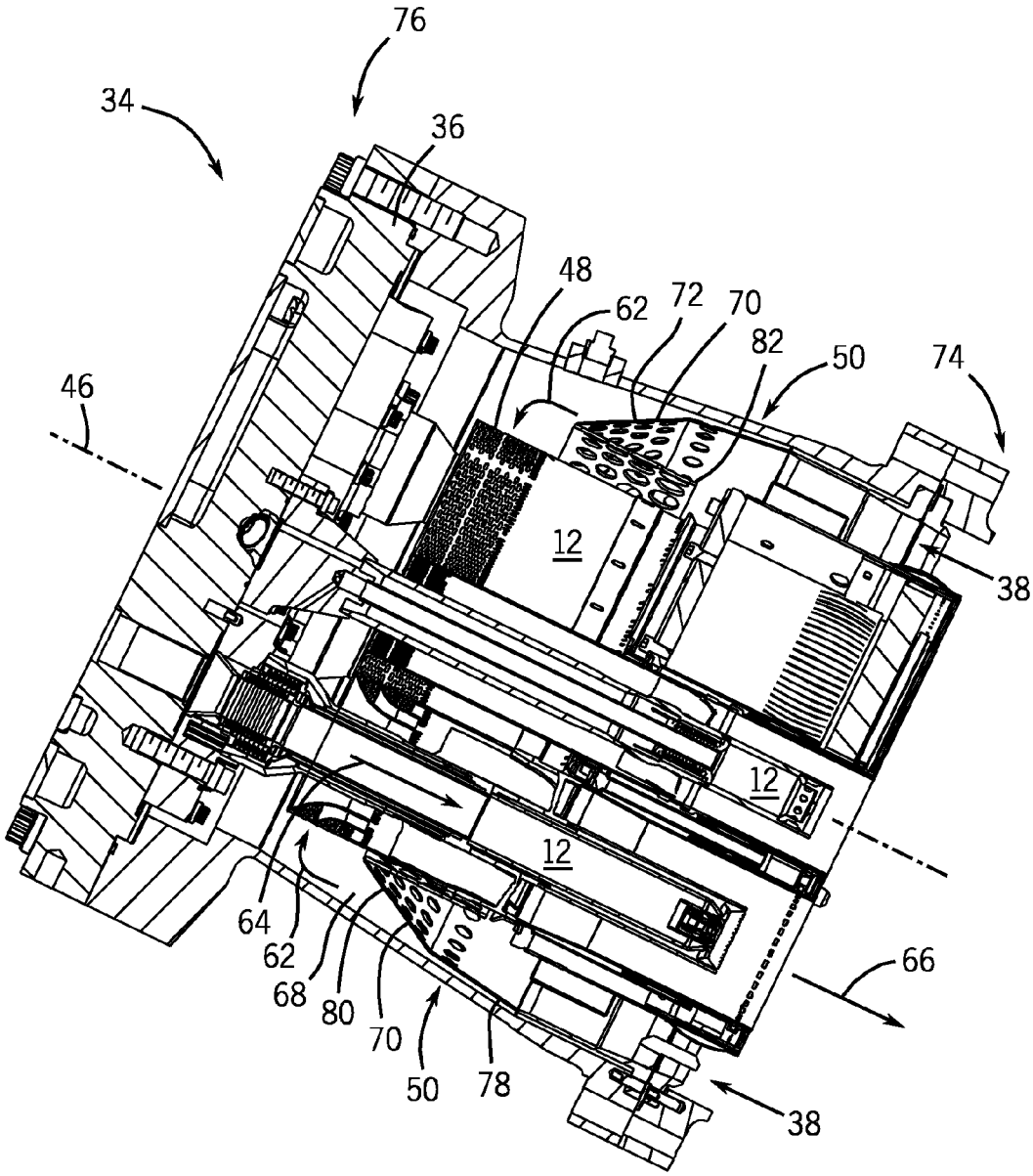
FIG. 4 is a cross sectional side view of an embodiment of the head end region within line 4-4 of FIG. 3, illustrating compressed air flowing into the head end region.

FIG. 4 is a cross sectional side view of an embodiment of the head end region 34 taken within line 4-4 of FIG. 3. As illustrated, the compressed air 38 may enter the head end region 34 and may turn into the inlet perforations 48 of the fuel nozzles 12, as illustrated by arrows 62. As discussed above, within the fuel nozzles 12, the compressed air 38 may be mixed with fuel and/or pressurized gas 64, which is introduced into the fuel nozzles 12 through conduits and valves through the end cover 36. The air/fuel mixture 66 may then be directed out of the head end region 34 and into the interior volume 52 of the combustor liner 44, as illustrated in FIG. 3.

As illustrated in FIG. 4, before entering the fuel nozzles 12, the compressed air 38 flowing into the head end region 34 may pass through the air flow conditioner 50, which is disposed in an air chamber 68 within the head end region 34. The air chamber 68 may be described as an air flow dump region or an air flow reversal region, as the air flow expands into a larger volume and reverses directions from an upstream flow direction to a downstream flow direction. As discussed above, the air flow conditioner 50 may improve the performance of the combustor 16 by ensuring that the compressed air 38 enters the fuel nozzles 12 more uniformly. In particular, the air flow conditioner 50 uniformly distributes the compressed air 38 between fuel nozzles 12 as well as distributing the compressed air 38 uniformly across individual nozzle profiles. In other words, the air flow conditioner 50 is configured to uniformly supply the flow of compressed air 38 into the inlet perforations 48 of the fuel nozzles 12 and uniformly distribute the flow of compressed air 38 among the plurality of fuel nozzles 12. More specifically, the air flow conditioner 50 is configured to direct the flow of compressed air 38 in both an axial direction and a radial direction relative to the central longitudinal axis 46 of the head end region 34.

As illustrated, the air flow conditioner 50 may include two main features which contribute to the compressed air 38 flow enhancements. In particular, the air flow conditioner 50 may include a perforated turning vane 70 configured to turn the compressed air 38 toward a central region of the air chamber 68. More specifically, the perforated turning vane 70 may gently turn the compressed air 38 toward the inlet perforations 48 of the fuel nozzles 12. For example, certain embodiments of the perforated turning vane 70 generally turn the air flow with one or more angled or curved structures, which may have an angle of at least greater than 0, 10, 20, 30, 40, 50, 60, 70, or 80 degrees relative to the longitudinal axis. The perforated turning vane 70 may include a perforated annular wall 72 disposed about the central longitudinal axis 46 of the head end region 34. The perforated annular wall 72 may change in diameter along the central longitudinal axis 46. For example, as illustrated in FIG. 4, the perforated annular wall 72 may gradually decrease in diameter along the central longitudinal axis 46 from a combustor end 74 to a head end 76. In certain embodiments, the perforated annular wall 72 may include more than one conical wall that converge or diverge in a linear manner along the central longitudinal axis 46. For example, as illustrated in FIG. 4, the perforated annular wall 72 includes a first perforated annular wall 78 connected to a second perforated wall 80. As shown, the first perforated annular wall 78 converges toward the central longitudinal axis 46 only gradually while the second perforated wall 80 converges toward the central longitudinal axis 46 more sharply. Indeed, as discussed in greater detail below, the perforated annular wall 72 may include various configurations and alignments which may enhance the flow of the compressed air 38 toward the fuel nozzles 12.

In certain embodiments, in addition to the perforated annular wall 72, the air flow conditioner 50 may also include a perforated cylinder 82. In essence, the perforated cylinder 82 may be an inner perforated annular wall of the air flow conditioner 50 which connects to the perforated annular wall 72 and extends back toward the combustor end 74 of the head end region 34. As illustrated in FIG. 4, the perforated cylinder 82 may constitute a perforated cylindrical wall disposed about the central longitudinal axis 46 of the head end region 34. The perforated cylinder 82 may have a generally constant diameter along the central longitudinal axis 46. In particular, in certain embodiments, the perforated cylinder 82 and the perforated annular wall 72 may generally be concentric with one another. In general, the perforated cylinder 82 may supplement the perforated annular wall 72 in turning the compressed air 38 toward the fuel nozzles 12 in an optimized manner.

Figure 5:
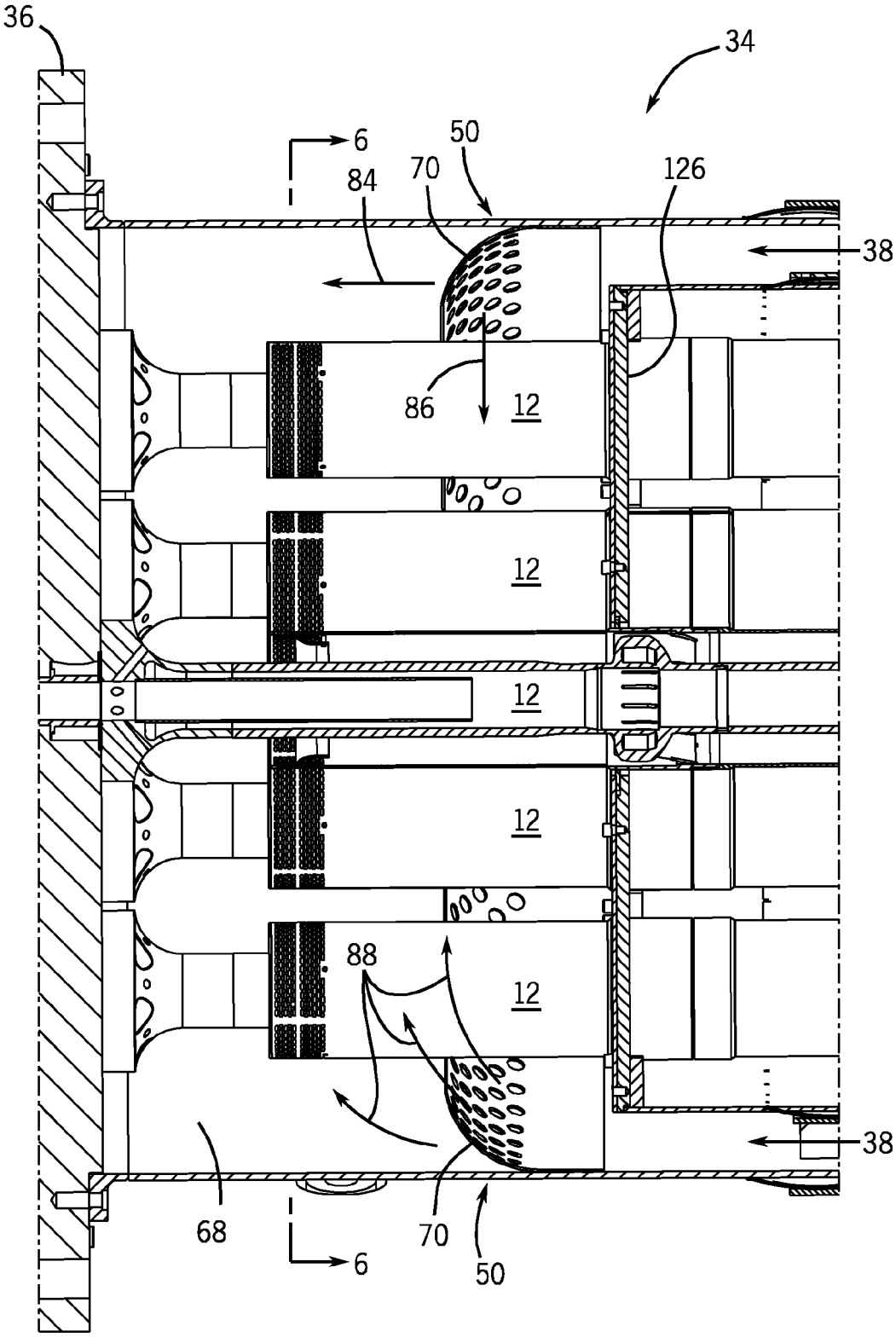
FIG. 5 is another cross sectional side view of an embodiment of the head end region within line 4-4 of FIG. 3, illustrating compressed air flowing into the head end region.

FIG. 5 is another cross sectional side view of an embodiment of the head end region 34. As discussed above, the compressed air 38 may enter the head end region 34 and flow across the air flow conditioner 50. As illustrated in FIG. 5, in certain embodiments, the air flow conditioner 50 may only include the perforated turning vane 70. As the compressed air 38 flows across the air flow conditioner 50, the compressed air 38 may be directed in both an axial direction 84 and a radial direction 86 relative to the central longitudinal axis 46 of the head end region 34. In general, the compressed air 38 directed in an axial direction 84 will be concentrated toward fuel nozzles 12 around a radial periphery of the head end region 34 whereas the compressed air 38 directed in a radial direction 86 will be more dispersed toward the fuel nozzles 12 located closer to the central longitudinal axis 46. As such, the compressed air 38 may be distributed more evenly among the fuel nozzles 12, as opposed to being concentrated toward fuel nozzles 12 near where the compressed air 38 enters the head end region 34. For instance, arrows 88 illustrate the compressed air 38 distributed more evenly between the plurality of fuel nozzles 12 in the head end region 34. In certain embodiments, the perforated turning vane 70 may be tuned to the particular arrangement of fuel nozzles, flow conditioners, and so forth. For example, the perforated turning vane 70 may be tuned by adjusting the angle, geometry, and length of the perforated turning vane 70, while also adjusting the number, size, and distribution of perforations.

Figure 6:
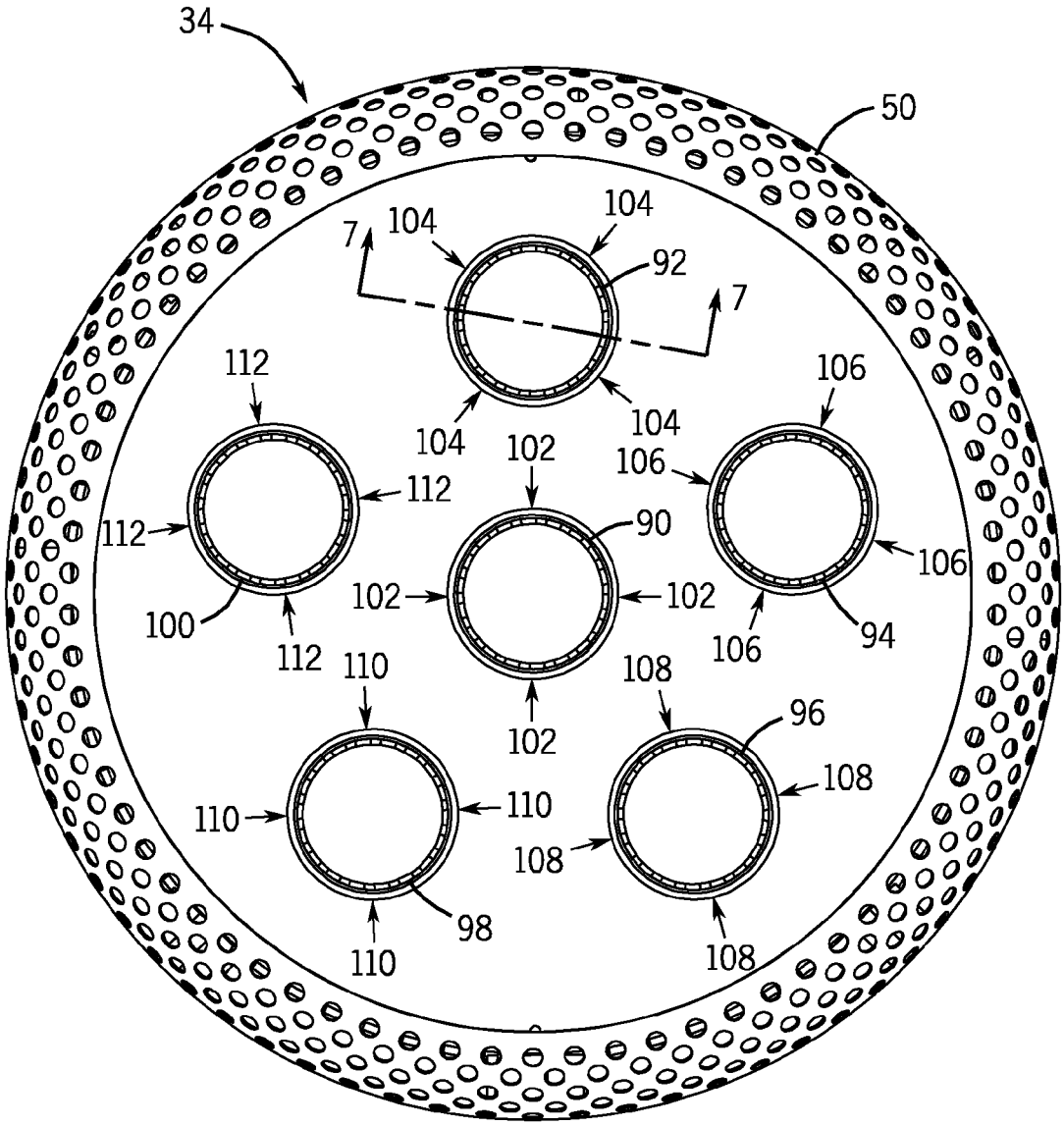
FIG. 6 is a cross sectional top view of an exemplary embodiment of the head end region along line 6-6 of FIG. 5, illustrating radially uniform distribution of compressed air between the fuel nozzles.

FIG. 6 is a cross sectional top view of an exemplary embodiment of the head end region 34 taken along line 6-6 in FIG. 5, illustrating radially uniform distribution of the compressed air 38 between the fuel nozzles 12. The head end region 34 may include a plurality of fuel nozzles 12. In particular, in certain embodiments, the head end region 34 may include one centrally located fuel nozzle 90 and a plurality of fuel nozzles 92, 94, 96, 98, and 100 disposed radially around the centrally located fuel nozzle 90. As discussed above, the air flow conditioner 50 may help ensure that the compressed air 38 is uniformly distributed between the fuel nozzles 90, 92, 94, 96, 98, and 100 as well as uniformly distributed around each individual fuel nozzle. For instance, air velocity vectors 102 for the centrally located fuel nozzle 90 and air velocity vectors 104, 106, 108, 110, and 112 for the radially disposed fuel nozzles 92, 94, 96, 98, and 100 are shown to illustrate how the compressed air 38 may be uniformly distributed by the air flow conditioner 50. As illustrated, the magnitude of the air velocity vectors 102, 104, 106, 108, 110, and 112 may be substantially similar for all of the fuel nozzles 90, 92, 94, 96, 98, and 100. In other words, the air velocity may be substantially the same into each of the fuel nozzles 90, 92, 94, 96, 98, and 100.

In some instances, without an air flow conditioner 50, the high velocity near the outer fuel nozzles 92, 94, 96, 98, and 100 may tend to starve the outer fuel nozzles 92, 94, 96, 98, and 100 of air while over-feeding the centrally located fuel nozzle 90. The air flow conditioner 50 reduces the tangential velocity near the outer fuel nozzles 92, 94, 96, 98, and 100 and consequently increases the static pressure around the outer fuel nozzles 92, 94, 96, 98, and 100 and allows for a more even distribution of air.

Moreover, when using the air flow conditioner 50, for each individual fuel nozzle 90, 92, 94, 96, 98, and 100, the magnitude of the air velocity vectors 102, 104, 106, 108, 110, and 112 may be substantially similar around the circumference of the particular fuel nozzle 90, 92, 94, 96, 98, and 100. For example, the magnitudes of each of the air velocity vectors 104 around the circumference of the radially disposed fuel nozzle 92 may be substantially the same. This, again, is due at least in part to the ability of the air flow conditioner 50 to uniformly distribute the compressed air 38 in a manner which may not be accomplished otherwise.

Figure 7:
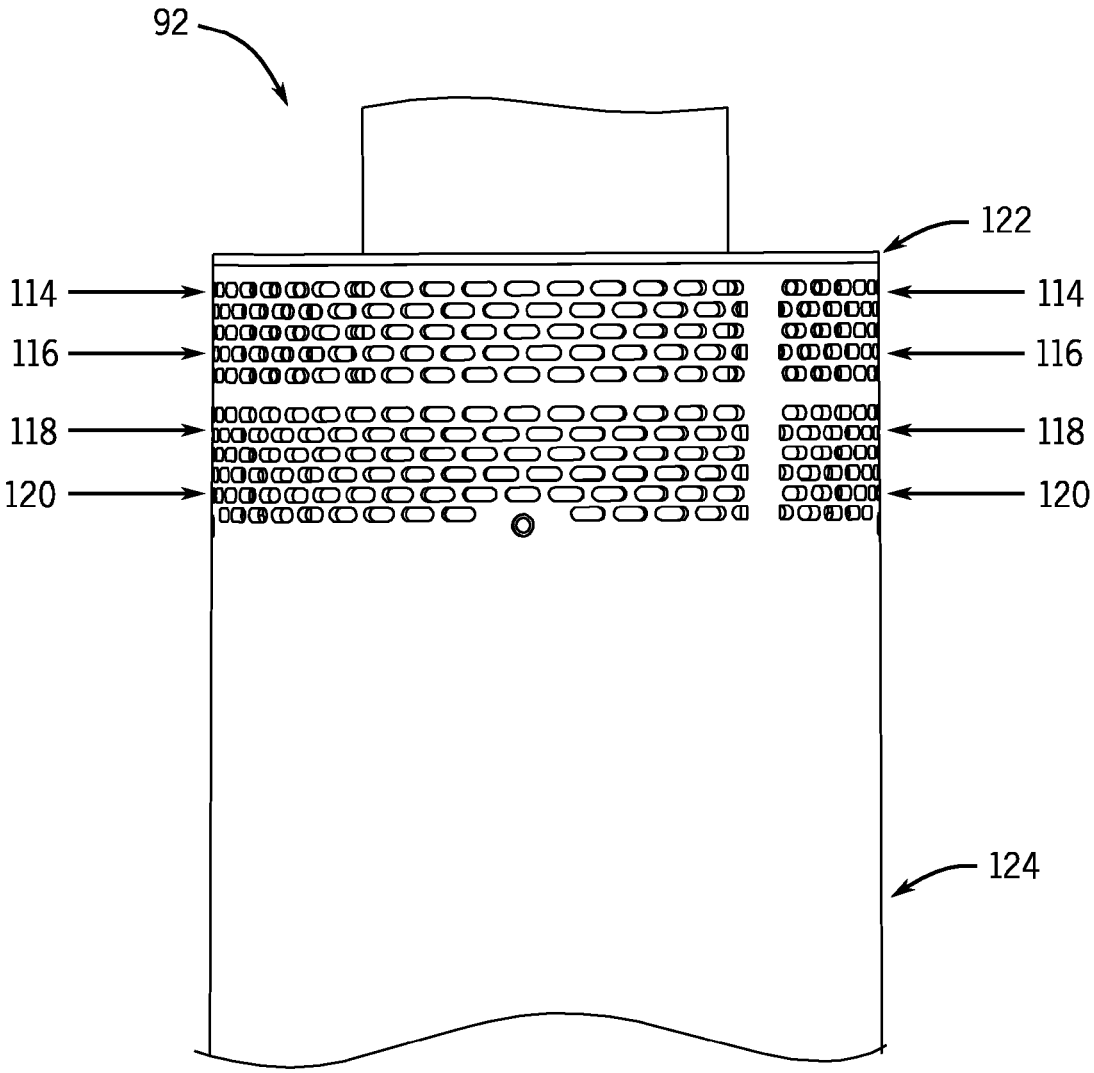
FIG. 7 is a partial cross sectional side view of an exemplary embodiment of one of the fuel nozzles taken along line 7-7 of FIG. 6, illustrating axially uniform distribution of compressed air.

In addition, FIG. 7 is a partial cross sectional side view of an exemplary embodiment of one of the fuel nozzles (e.g., 92) taken along line 7-7 of FIG. 6, illustrating axially uniform distribution of the compressed air 38. In particular, for fuel nozzle 92, air velocity vectors 114, 116, 118, and 120 are illustrated at multiple axial locations along the length of the fuel nozzle 92. In particular, the air velocity vectors 114 may be near a head end 122 of the fuel nozzle 92 and the air velocity vectors 120 may be near a combustor end 124 of the fuel nozzle 92. In other words, the air velocity vectors 120 may be nearer to where the compressed air 38 enters the head end region 34 whereas the air velocity vectors 114 may be farther away from where the compressed air 38 enters the head end region 34.

As illustrated in FIG. 7, the magnitude of the air velocity vectors 114, 116, 118, and 120 may all be substantially similar. In other words, the air velocity may be substantially the same at each of the corresponding axial locations. This illustrates how the compressed air 38 may be more uniformly distributed axially for the fuel nozzle 92.

Figure 8:
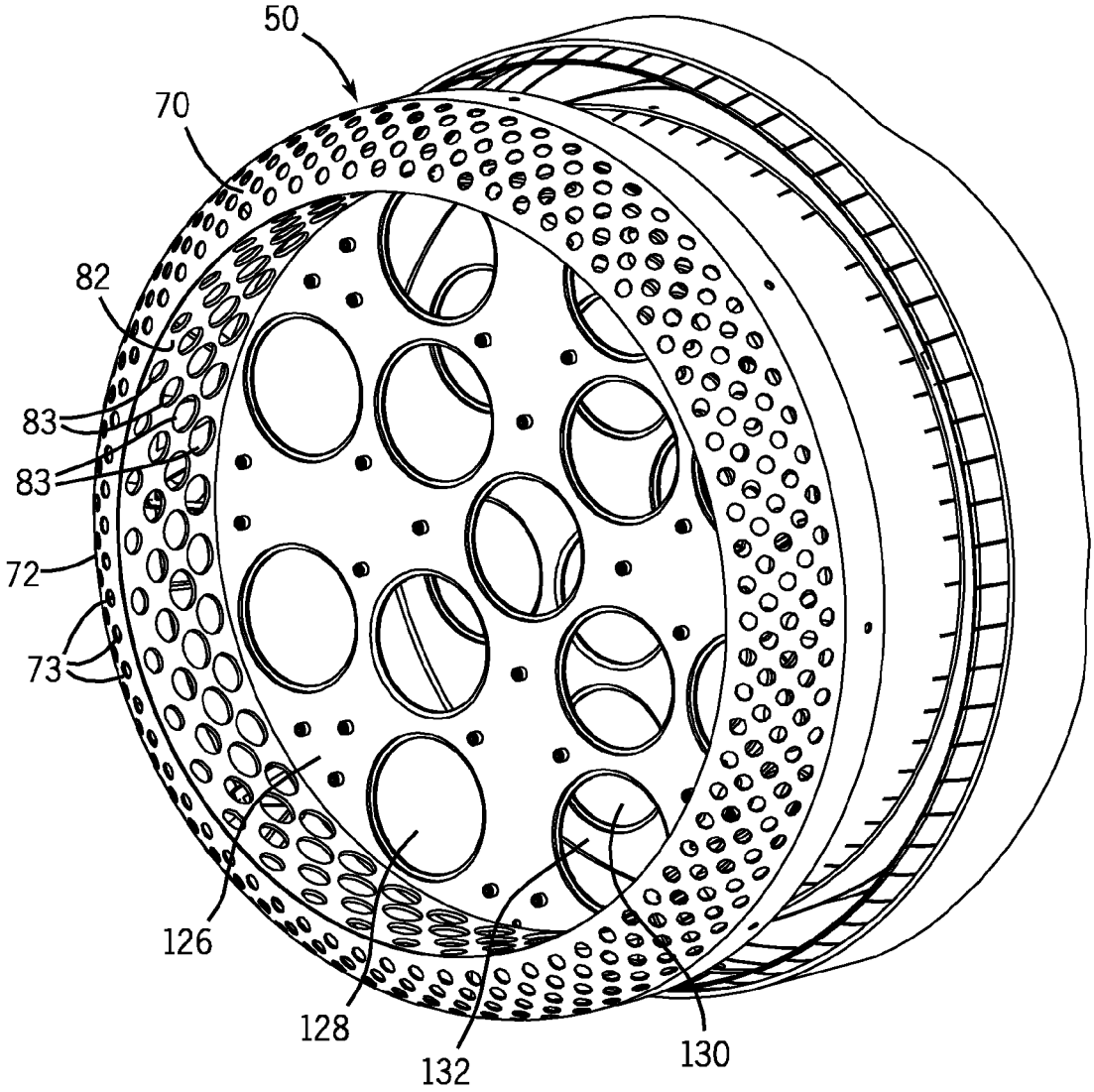
FIG. 8 is a perspective view of an exemplary embodiment of a divider and air flow conditioner that may be used in the head end region.

Returning now to FIG. 5, the air chamber 68 of the head end region 34 may be separated from the combustor 16 by a divider 126, otherwise known as a "cap." FIG. 8 is a perspective view of an exemplary embodiment of the divider 126 and the air flow conditioner 50. As illustrated in FIG. 8, the divider 126 may include a plurality of openings 128 to receive and support the fuel nozzles 12. In particular, the openings 128 may be configured to form seals against outer cylindrical walls of the fuel nozzles 12. In certain embodiments, as illustrated, the perforated cylinder 82 associated with the air flow conditioner 50 may be connected to the divider 126. In addition, in certain embodiments, the fuel nozzles 12 may be disposed between openings 130 of a secondary divider 132, further isolating the air chamber 68 of the head end region 34 from the combustor 16. In certain embodiments, pre-mixing assemblies may be located in the space between the dividers 126, 132.

As described above, the perforated turning vane 70 of the air flow conditioner 50 may enable uniform distribution of the compressed air 38 between the fuel nozzles 12 of the head end region 34. As illustrated in FIG. 8, the perforated turning vane 70 may comprise an annular shape with a substantially constant profile in a circumferential direction about the axis 46. However, the particular cross sectional profile of the annular perforated turning vane 70 may vary. For example, the geometry, distribution of perforations, and size of perforations may be constant or variable in the axial direction, the radial direction, and/or the circumferential direction relative to the axis 46. In the illustrated embodiment, perforations 73 on the perforated annular wall 72 are sized smaller and packed more closely together than perforations 83 on the perforated cylinder 82. In addition, the perforations 73 have a constant diameter, whereas the perforations 83 decrease in diameter in the upstream direction. Other various combinations of geometry, distribution of perforations, and size of perforations may also be implemented.

Figure 9A:
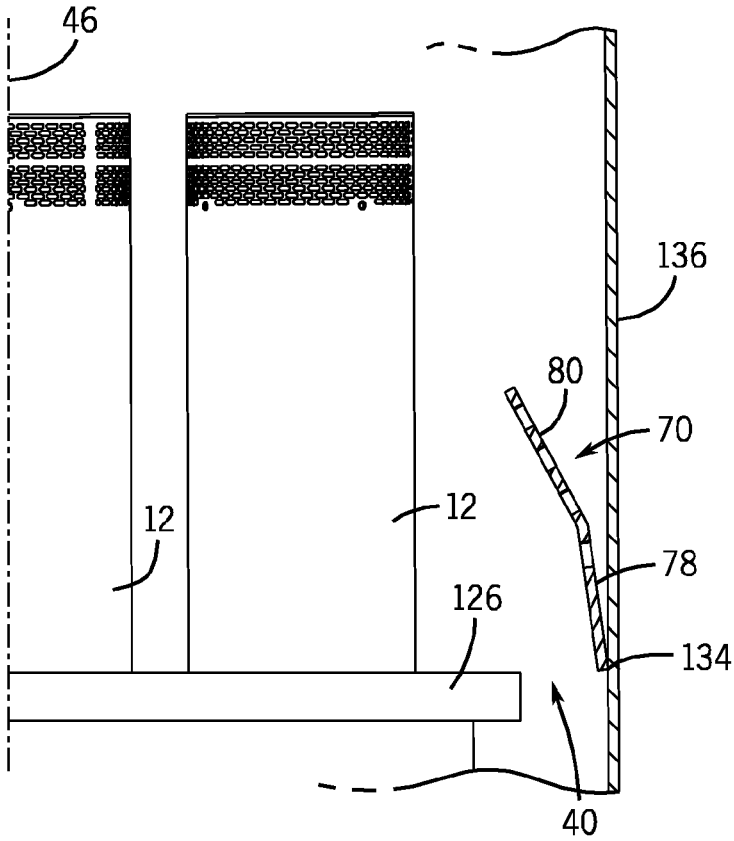
FIG. 9A is a partial cross sectional profile of a perforated turning vane of the air flow conditioner consistent with FIGS. 3 and 4.
Figure 9B:
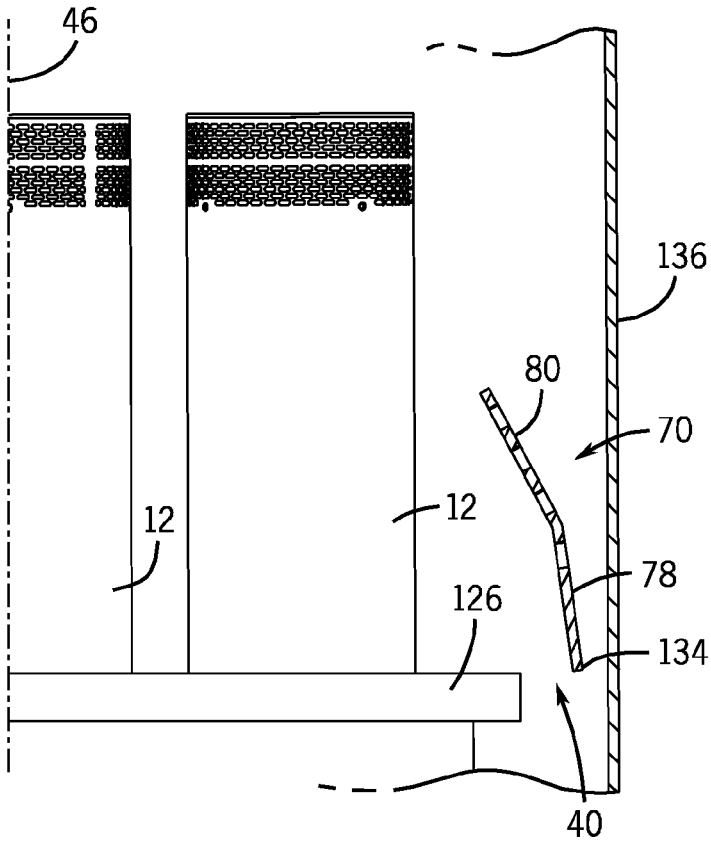
FIG. 9B is a partial cross sectional profile of the perforated turning vane of FIG. 9A, wherein a leading edge of the perforated turning vane is not connected to an outer wall of the head end region.

FIGS. 9A through 9H are partial cross sectional profile views of exemplary embodiments of the perforated turning vane 70 of the air flow conditioner 50. FIG. 9A illustrates a partial cross sectional profile of the perforated turning vane 70 consistent with the air flow conditioners 50 illustrated in FIGS. 3 and 4. Specifically, the illustrated perforated turning vane 70 includes a first perforated annular wall 78 connected to a second perforated annular wall 80. In the illustrated embodiment, the first perforated annular wall 78 converges toward the central longitudinal axis 46 of the head end region 34 only gradually while the second perforated wall 80 converges toward the central longitudinal axis 46 more sharply. In general, however, the illustrated embodiment of the perforated turning vane 70 includes a cross sectional profile, which includes two linearly converging perforated wall sections 78, 80. In the illustrated embodiment, a leading edge 134 of the first perforated annular wall 78 may be connected to an inner surface of an outer wall 136 of the head end region 34. However, as illustrated in FIG. 9B, the leading edge 134 of the first perforated annular wall 78 may not be connected to the outer wall 136 of the head end region 34. Furthermore, in certain embodiments, the leading edge 134 of the first perforated annular wall 78 may be centered radially within the annular passage 40 through which the compressed air 38 flows into the head end region 34. This may create an annular gap for air flow around the perforated turning vane 70.

Figure 9C:
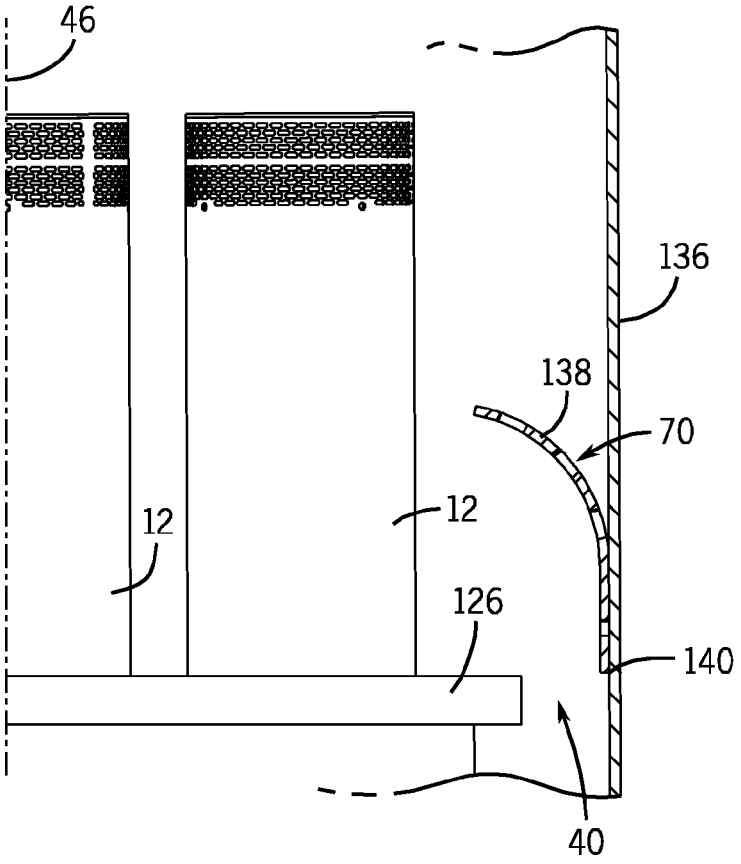
FIG. 9C is a partial cross sectional profile of a perforated turning vane of the air flow conditioner consistent with FIGS. 5 and 8.
Figure 9D:
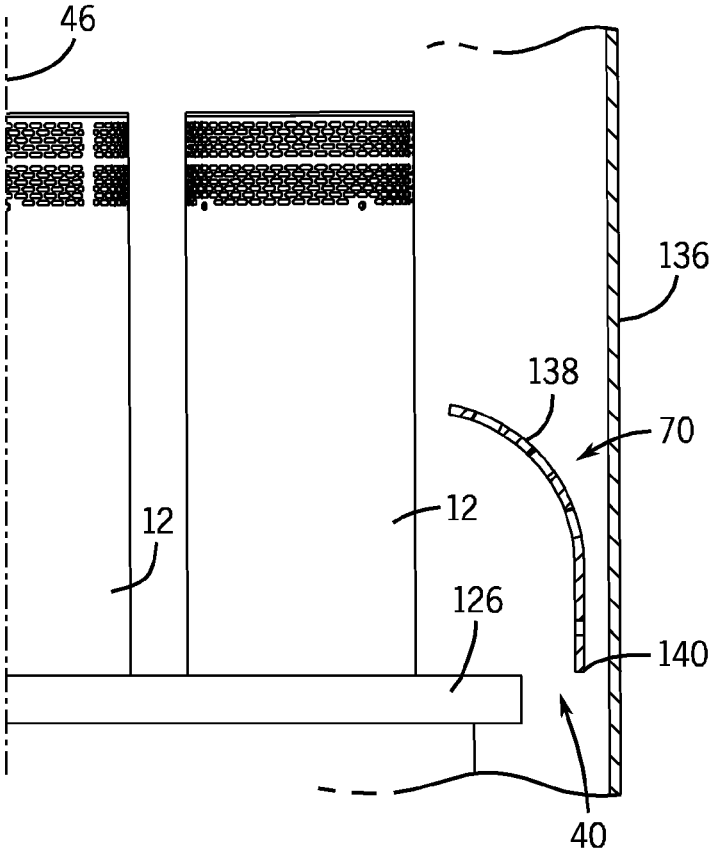
FIG. 9D is a partial cross sectional profile of the perforated turning vane of FIG. 9C, wherein a leading edge of the perforated turning vane is not connected to an outer wall of the head end region.

FIG. 9C illustrates a partial cross sectional profile of the perforated turning vane 70 consistent with the air flow conditioners 50 illustrated in FIGS. 5 and 8. Specifically, the illustrated perforated turning vane 70 includes a curved perforated annular wall 138. In the illustrated embodiment, the curved perforated annular wall 138 has a concave shape toward the central longitudinal axis 46 of the head end region 34. However, in other embodiments, the curved perforated annular wall 138 may be slightly convex instead. In addition, in certain embodiments, the perforated turning vane 70 may include multiple wall sections with varying degrees of curvature (e.g., C-shaped, U-shaped, J-shaped, S-shaped, and so forth). In the illustrated embodiment, a leading edge 140 of the curved perforated annular wall 138 may be connected to the outer wall 136 of the head end region 34. However, as illustrated in FIG. 9D, the leading edge 140 of the curved perforated annular wall 138 may not be connected to the outer wall 136 of the head end region 34. Furthermore, in certain embodiments, the leading edge 140 of the curved perforated annular wall 138 may be centered radially within the annular passage 40 through which the compressed air 38 flows into the head end region 34. Again, this may create an annular gap for air flow around the perforated turning vane 70.

Figure 9E:
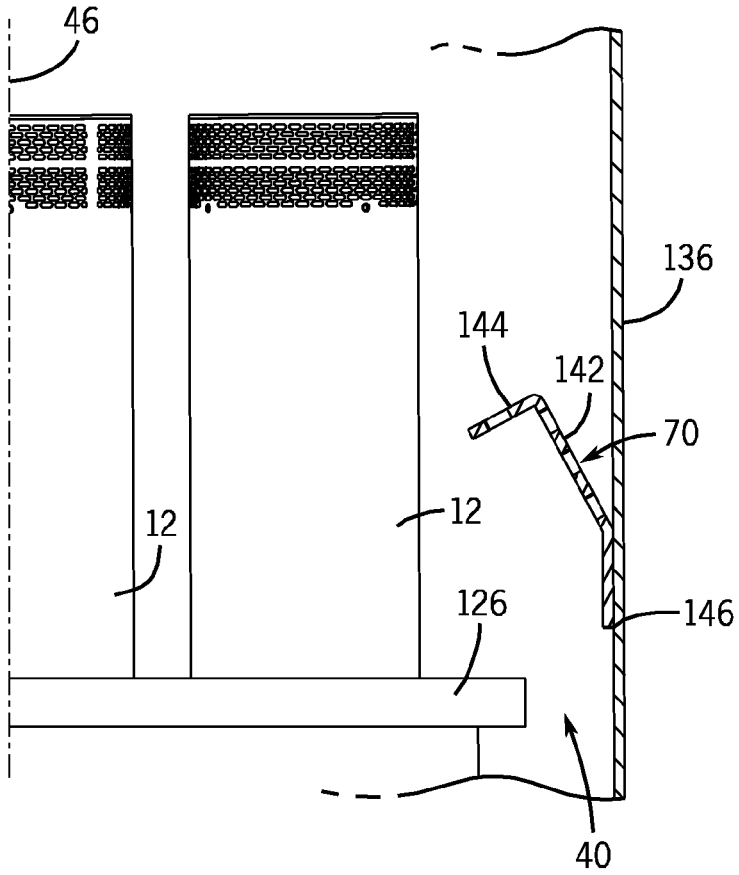
FIG. 9E is a partial cross sectional profile of an L-shaped perforated turning vane of the air flow conditioner.

However, these linear and curvilinear profiles are only some of the types of profiles that may be used for the perforated turning vanes 70. In addition, more complex shapes may be used. For instance, FIG. 9E illustrates a partial cross sectional profile for an L-shaped perforated turning vane 70. As illustrated, the perforated turning vane 70 may include a first perforated wall 142 which converges linearly toward the central longitudinal axis 46 of the head end region 34 and a second perforated wall 144 which is connected to the first perforated wall 142 and also converges linearly toward the central longitudinal axis 46. However, the second perforated wall 144 points back toward the divider 126, forming an L-shaped section between the first perforated wall 142 and the second perforated wall 144. In certain embodiments, while the shape between the first perforated wall 142 and the second perforated wall 144 may generally be triangular, the first and second perforated walls 142, 144 may not be perfectly linear. Rather, the first and second perforated walls 142, 144 may be curvilinear while still forming a generally triangular shape between them. As discussed above with respect to FIGS. 9A through 9D, a leading edge 146 of the perforated turning vane 70 may be either connected or not connected to the outer wall 136 of the head end region 34.

Figure 9F:
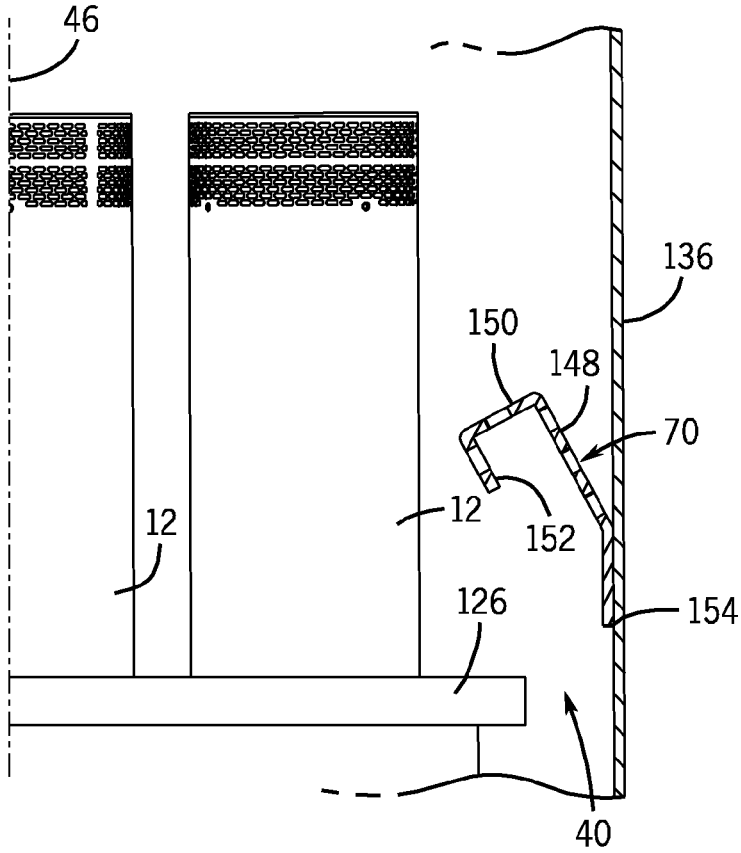
FIG. 9F is a partial cross sectional profile of a hook-shaped perforated turning vane of the air flow conditioner.

FIG. 9F illustrates a partial cross sectional profile for a hook-shaped perforated turning vane 70. As illustrated, the perforated turning vane 70 may include a first perforated wall 148 which converges linearly toward the central longitudinal axis 46 of the head end region 34 and a second perforated wall 150 which is connected to the first perforated wall 148 and also converges linearly toward the central longitudinal axis 46. However, the second perforated wall 150 points back toward the divider 126. In addition, the air flow conditioner 50 may include a third perforated wall 152 which is connected to the second perforated wall 150 but diverges away from the central longitudinal axis 46 while pointing back toward the outer wall 136 of the head end region 34, forming a hook-shaped section between the first perforated wall 148, the second perforated wall 150, and the third perforated wall 152. In certain embodiments, while the shape between the first perforated wall 148, the second perforated wall 150, and the third perforated wall 152 may generally be rectangular, the first, second, and third perforated walls 148, 150, 152 may not be perfectly linear. Rather, the first, second, and third perforated walls 148, 150, 152 may be curvilinear while still forming a generally rectangular shape between them. Again, as discussed above with respect to FIGS. 9A through 9D, a leading edge 154 of the perforated turning vane 70 may be either connected or not connected to the outer wall 136 of the head end region 34.

Figure 9G:
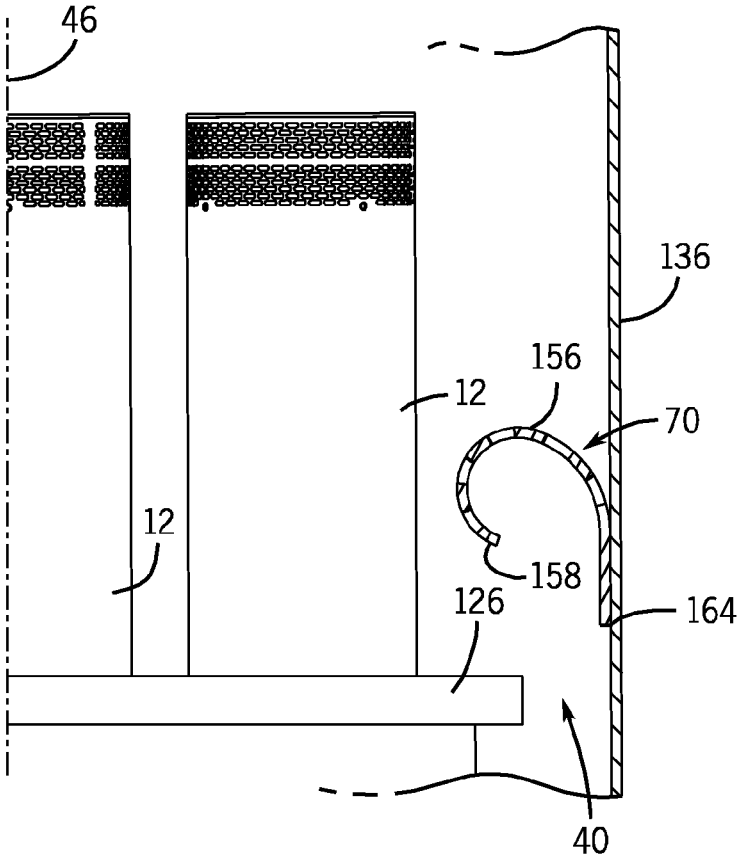
FIG. 9G is a partial cross sectional profile of a curved perforated turning vane of the air flow conditioner.
Figure 9H:
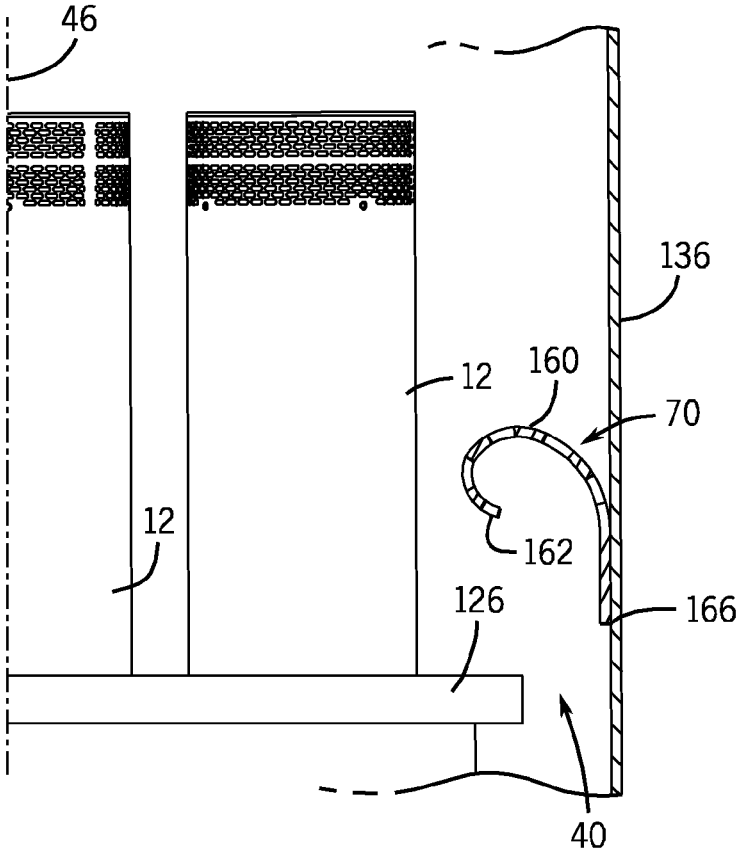
FIG. 9H is a partial cross sectional profile of another curved perforated turning vane of the air flow conditioner.

FIG. 9G and 9H illustrate two other partial cross sectional profiles for the perforated turning vane 70 which are somewhat similar. For example, FIG. 9G illustrates a partial cross sectional profile of the perforated turning vane 70 which includes a perforated wall 156 with a ¾ torus 158. In addition, other amounts of curvature (e.g., at least 50, 60, 70, 80, or 90% of a full circle) of the perforated wall 156 may be used. As such, the perforated wall 156 will wrap back toward itself in a generally circular manner. Similarly, FIG. 9H illustrates a partial cross sectional profile of the perforated turning vane 70 which includes a perforated wall 160 with a curved trailing edge 162 pointing back toward the annular passage 40 through which the compressed air 38 flows into the head end region 34. For each of these embodiments, the particular shape of the cross sectional profile of the perforated turning vane 70 may vary. However, in general, the embodiments include cross sectional profiles of the perforated turning vane 70 where a trailing edge of a curved perforated wall points back toward the annular passage 40. Again, as discussed above with respect to FIGS. 9A through 9D, leading edges 164, 166 of the perforated turning vanes 70 illustrated in FIGS. 9G and 9H may be either connected or not connected to the outer wall 136 of the head end region 34.

Figure 10:
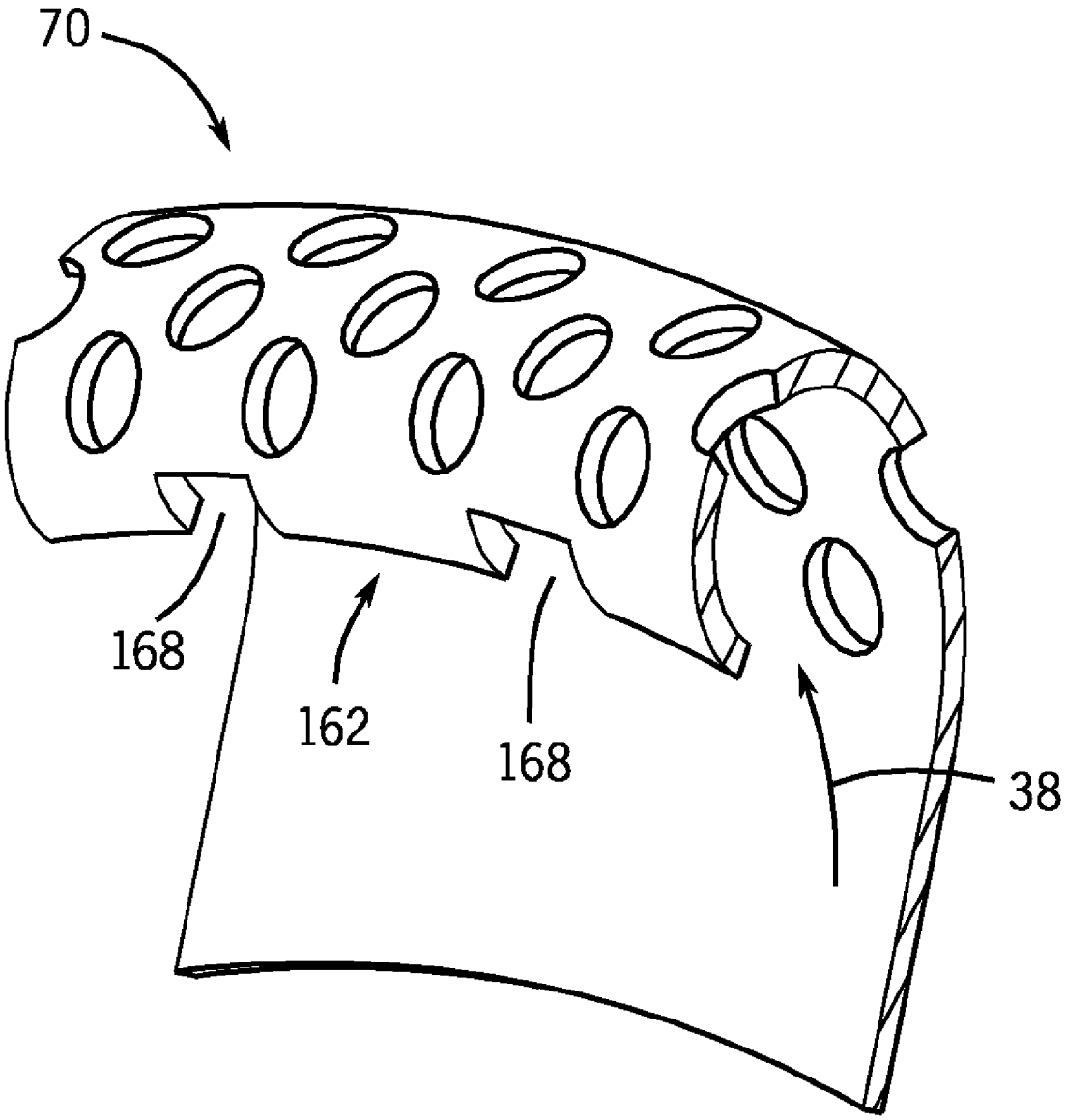
FIG. 10 is a perspective view of a portion of an exemplary embodiment of the perforated turning vane.

Each of the embodiments of the perforated turning vane 70 illustrated in FIGS. 9E through 9H share the specific feature of a trailing edge which may, to a certain extent, directly impede the flow of compressed air 38 into the air chamber 68 of the head end region 34. For instance, FIG. 10 is a perspective view of a portion of an exemplary embodiment of the perforated turning vane 70. Specifically, the perforated turning vane 70 illustrated in FIG. 10 is the perforated turning vane 70 of FIG. 9H, which includes the curved trailing edge 162 which points back toward the annular passage 40 through which the compressed air 38 flows into the head end region 34. As compressed air 38 enters the air chamber 68 of the head end region 34, the curved trailing edge 162 may substantially impede the flow of the compressed air 38. To somewhat mitigate this, the trailing edge 162 may include "castled" or "zig-zag" designs, which include cutouts 168 in the trailing edge 162. In certain embodiments, the cutouts 168 may be rectangular, however, other cutout shapes (e.g., triangular, circular, and so forth) may also be used. The cutouts 168 may prevent the full velocity of the compressed air 38 from being experienced by the trailing edge 162.

Conversely, certain embodiments of the perforated turning vane 70 described in FIGS. 9A through 9H do not include trailing edges which, to a certain extent, directly impede the flow of compressed air 38 into the air chamber 68 of the head end region 34. For instance, the embodiments of the perforated turning vane 70 illustrated in FIGS. 9A through 9D include cross sectional profiles that redirect the compressed air 38 into the air chamber 68 more gradually. As such, the embodiments illustrated in FIGS. 9A through 9D may, in certain embodiments, use solid walls instead of perforated walls. Although using solid walls may not allow for the compressed air 38 to be directed through the walls of the turning vanes 70, the solid walls still redirect the compressed air 38 toward the central longitudinal axis 46 of the head end region 34, thereby promoting more uniform air distribution to the fuel nozzles 12. Also, in embodiments which do use perforations, the size, number, and distribution of perforations may be varied.

The embodiments of the air flow conditioner 50 described herein may be beneficial in a number of ways. In particular, since the air flow conditioner 50 produces a more uniform distribution of compressed air 38 between the fuel nozzles 12, there will similarly be uniform static pressure fields around the air inlets of the fuel nozzles 12. In addition, the uniform static pressure enables a more balanced mass flow of air through all of the fuel nozzles 12, thereby promoting more consistent mixing of air and fuel. Additionally, since each fuel nozzle 12 experiences substantially similar amounts of air flow, a single fuel nozzle 12 design may be utilized, thereby reducing hardware or initial cost expenses. Furthermore, emissions may be improved since there will be a more constant mixing of air and fuel. Other benefits may include more uniform air profiles in the fuel nozzles 12, which enables the fuel nozzles 12 to have better flame holding performance. In particular, since the air profile in the fuel nozzle 12 is more uniform, it is less likely to have zones of reduced velocity, which can allow a flame to anchor inside the fuel nozzle 12 and destroy hardware.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a turbine engine, comprising:

a combustor, comprising:

a combustion chamber;

a liner disposed about the combustion chamber;

a sleeve disposed about the liner;

an air supply path between the liner and the sleeve;

an air chamber;

a divider disposed axially between the combustion chamber and the air chamber relative to a longitudinal axis of the combustor;

a fuel nozzle extending through the divider, wherein the fuel nozzle has an air inlet in the air chamber and an outlet in the combustion chamber; and an air flow conditioner disposed in the air chamber in line with the air supply path into the air chamber, wherein the air flow conditioner comprises a first perforated turning wall extending circumferentially about the longitudinal axis in a radially overlapping position relative to the air supply path, the first perforated turning wall comprises a first plurality of openings configured to pass a first portion of an air flow from the air supply path in an upstream direction away from the combustion chamber, and the first perforated turning wall is angled inwardly from the air flow path toward the longitudinal axis in the upstream direction to turn a second portion of the air flow from the air supply path inwardly toward a central region of the air chamber.

2. The system of claim 1, wherein the first perforated turning wall comprises a first perforated annular wall disposed about the longitudinal axis of the combustor, and the first perforated annular wall decreases in diameter along the longitudinal axis in the upstream direction away from the combustion chamber.

3. The system of claim 2, wherein the first perforated annular wall comprises one or more perforated conical walls disposed about the longitudinal axis.

4. The system of claim 2, wherein the first perforated annular wall curves in a convex or concave manner along the longitudinal axis.

5. The system of claim 2, wherein the air flow conditioner comprises a perforated cylinder having a second perforated annular wall disposed about the longitudinal axis of the combustor, and the second perforated annular wall has a generally constant diameter along the longitudinal axis.

6. The system of claim 5, wherein the first and second perforated annular walls are concentric with one another.

7. The system of claim 1, wherein the fuel nozzle comprises an inlet flow conditioner at the air inlet, the inlet flow conditioner comprises nozzle perforations, and the inlet flow conditioner is separate from the air flow conditioner.

8. The system of claim 1, wherein the air flow conditioner is configured to uniformly supply the air flow into the air inlet of the fuel nozzle.

9. The system of claim 1, comprising a plurality of fuel nozzles extending through the divider, wherein the air flow conditioner is configured to uniformly distribute the air flow among the plurality of fuel nozzles.

10. A system, comprising:

an air flow conditioner configured to mount in an air chamber separated from a combustion chamber of a turbine combustor, wherein the air flow conditioner comprises a first perforated annular turning wall having a first plurality of openings, the first perforated annular turning wall is configured to radially overlap with an air supply path between a combustor liner and a flow sleeve of the turbine combustor, the first plurality of openings is configured to pass a first portion of an air flow from the air supply path in an upstream direction away from the combustion chamber, and the first perforated annular turning wall is angled inwardly from the air flow path toward a longitudinal axis of the turbine combustor in the upstream direction to turn a second portion of the air flow from the air supply path inwardly toward a central region of the air chamber, and the air flow conditioner is configured to distribute the air flow into air inlets of one or more fuel nozzles.

11. The system of claim 10, wherein the first perforated annular turning wall decreases in diameter along the longitudinal axis in the upstream direction away from the combustion chamber.

12. The system of claim 11, wherein the first perforated annular turning wall comprises one or more perforated conical walls disposed about the longitudinal axis.

13. The system of claim 11, wherein the first perforated annular turning wall curves in a convex or concave manner along the longitudinal axis.

14. The system of claim 11, wherein the air flow conditioner comprises a perforated cylinder concentric with the first perforated annular turning wall and the longitudinal axis, and the perforated cylinder has a generally constant diameter along the longitudinal axis.

15. The system of claim 10, wherein the air flow conditioner is configured to mount in the air chamber at an axial position that is axially offset from the air inlets of the one or more fuel nozzles.

16. The system of claim 10, comprising the turbine combustor and the one or more fuel nozzles, wherein the fuel nozzles extend through a divider between the air chamber and the combustion chamber.

17. A system, comprising:

a turbine combustor, comprising:

a combustion chamber;

a liner extending around the combustion chamber;

a sleeve extending around the liner;

an air supply path between the liner and the sleeve; and a head end upstream from the combustion chamber relative to a flow of combustion products, wherein the head end comprises:

a fuel nozzle disposed in the head end; and an air flow conditioner disposed in the head end, wherein the air flow conditioner comprises a first perforated turning wall that radially overlaps the air supply path, the first perforated turning wall comprises a first plurality of openings, and the first perforated turning wall is angled inwardly from the air flow path toward a longitudinal axis of the turbine combustor in an upstream direction away from the combustion chamber.

18. The system of claim 17, wherein the fuel nozzle has a base mounted to an end cover of the head end, the fuel nozzle has an intermediate portion mounted to a cap of the head end, the fuel nozzle has the inlet in an air chamber between the end cover and the cap, and the air flow conditioner is disposed adjacent to the cap.

19. The system of claim 17, wherein the first plurality of openings of the first perforated turning wall is configured to pass a first portion of an air flow from the air supply path in the upstream direction away from the combustion chamber, and the first perforated turning wall is angled inwardly from the air flow path toward the longitudinal axis in the upstream direction to turn a second portion of the air flow from the air supply path inwardly toward a central region of the head end.

20. The system of claim 17, wherein the first perforated turning wall comprises a first perforated annular wall that decreases in diameter along the longitudinal axis in the upstream direction away from the combustion chamber.

21. The system of claim 17, wherein the fuel nozzle comprises an air inlet at a first axial position relative, to the longitudinal axis of the turbine combustor, wherein the air flow conditioner is disposed at a second axial position relative to the longitudinal axis, wherein the first axial position is different from the second axial position.

22. The system of claim 17, wherein the air flow conditioner comprises a second perforated wall that is concentric with the first perforated turning wall.

23. A system, comprising:

an air flow conditioner configured to mount in a head end air chamber of a turbine combustor in line with an air supply path radially between a combustor liner and a flow sleeve, wherein the air flow conditioner comprises a first perforated turning wall that radially overlaps the air supply path, the first perforated turning wall comprises a first plurality of openings, the first perforated turning wall is angled inwardly from the air flow path toward a longitudinal axis of the turbine combustor in an upstream direction away from a combustion chamber, a second perforated wall is disposed in a concentric arrangement relative to the first perforated turning wall and the longitudinal axis of the turbine combustor, and the first perforated turning wall is angled related to the second perforated wall.

24. The system of claim 23, wherein the first perforated turning wall has a first diameter that decreases in the upstream direction away from the combustion chamber when mounted in the head end air chamber.

25. The system of claim 24, wherein the second perforated wall has a second diameter that is generally constant.

26. The system of claim 23, comprising the turbine combustor, a turbine engine, or a combustion thereof, having the air flow conditioner.

* * * * *